US007682261B1

(12) United States Patent
Addington et al.

(10) Patent No.: US 7,682,261 B1
(45) Date of Patent: Mar. 23, 2010

(54) BOWLERS FINGER PAD SHIELD

(76) Inventors: Randall A. Addington, 2477 St. Johns, Melbourne, FL (US) 32953; W. Robert Addington, 2477 St. Johns, Melbourne, FL (US) 32953; W. Robert Addington, II, 2477 St. Johns, Melbourne, FL (US) 32953

( * ) Notice: Subject to any disclaimer, the term of this patent is extended or adjusted under 35 U.S.C. 154(b) by 1395 days.

(21) Appl. No.: 09/396,531

(22) Filed: Sep. 15, 1999

Related U.S. Application Data

(63) Continuation of application No. 09/130,905, filed on Aug. 7, 1998, now abandoned.

(51) Int. Cl.
*A41D 19/00* (2006.01)

(52) U.S. Cl. ..... 473/61; 2/21; 2/161.1

(58) Field of Classification Search ..... 473/59, 473/61, 62; D29/114; 2/21, 161.1, 163
See application file for complete search history.

(56) References Cited

U.S. PATENT DOCUMENTS 617,929 A * 1/1899 Fowble
5,881,388 A * 3/1999 Pratt

* cited by examiner

*Primary Examiner*—William M Pierce
(74) *Attorney, Agent, or Firm*—Joel I. Rosenblatt

(57) ABSTRACT

The finger pad shield, when placed in contact with the bowler's finger pad places a rigid surface between the force against the finger pad and spreads that force, when the bowler's maximum natural force is applied to the bowling ball at the moment of release. It is at this moment when the force of the ball against the finger pad is the greatest and the pressure within the contact area made by the finger pad shield with the finger pad, would be increased if that bowling ball force was not spread over that contact area. The rigid finger pad shield is made sufficiently rigid material to substantially resist the force of the bowling ball so the force against the finger pad shield 14 is spread over the contact area.

4 Claims, 8 Drawing Sheets

BOWLERS FINGER PAD SHIELD

This is a continuation of earlier filed application Ser. No. 09/130,905 filed Aug. 7, 1998 now abandoned and which this application contains a specific reference to and the benefit of its earlier filing date under 35 U.S.C. 120.

FIELD OF THE INVENTION

This invention is in the field of bowling. It is related to a finger pad shield for assisting a bowler in using the maximum force of the bowler's finger, in the release of the bowling ball.

BACKGROUND OF THE INVENTION

Because of bowling's popularity, bowlers are continually demonstrating interest in improving their game. In bowling, the position of the fingers placed in the bowling ball holes is important to the delivery of the ball. As is well-known in delivering a bowling ball, the ball is gripped by the thumb and one or two other fingers. As the bowler is preparing to deliver the ball down the alley, the ball is swung back in preparation for the final delivery. As the bowler proceeds to deliver the ball, the ball held in the bowler's grip is then swung forward. As the bowler's arm is at the end of this forward motion, the critical moment of release is reached. It is at the moment of delivery of the ball when the bowler has his or her last opportunity to release the ball, down the alley towards the pins, with the correct amount of direction, spin and velocity. The importance of the delivery, as explained above, is in the achievement of direction, spin and velocity.

Attempts to assist or aid the bowler in the delivery of the bowling ball have used various means to support or position the wrist or fingers. Many of these devices were designed to correct any tendency of the hand, wrist or fingers to deviate from an optimum position, where the delivery of the bowling ball would be expected to achieve the optimum result of a strike, or all the pins are knocked over by the first ball. Such previous devices were unable to achieve the effect of maximum control of the bowling ball at the point of release, through natural use of the bowler's finger inserted in the bowling ball hole, as is the invention disclosed in this application.

Such previous devices were unable to achieve the effect of maximum natural control of the bowling ball at the point of release, through the finger inserted in the bowling ball finger hole, as is the invention disclosed in this application.

For example, in U.S. Pat. No. 4,441,711, a wrist and finger support is shown. However, the support is along the dorsal or back surface of a finger which is placed along the surface of the bowling ball, and not used in connection with a bowler's finger used in the hole of the bowling ball. The device in U.S. Pat. No. 4,441,711 does not extend to the tip of the bowler's finger and cannot produce any effect through the finger tip when the ball is released.

U.S. Pat. No. 4,273,330 shows a bowler's finger support for the little finger, It is not designed or intended for a bowler's finger inserted into the hole of a bowling ball. It is intended to be used on the little finger pressed to the surface of the bowling ball and to force the bowling ball toward the index finger.

U.S. Pat. No. 4,371,163 shows a bowler's wrist and finger control device using a support for the dorsal surface of the bowler's forefinger, similar to the devise shown in U.S. Pat. No. 4,441,711. It is used to support a finger placed on the surface of the ball and to make it easier for the bowler to extract the thumb from the ball and transfer the ball to the fingers inserted in the bowling ball holes. The device of this patent does not provide any aid in controlling the ball at the point of release, by a finger inserted into the bowling ball.

U.S. Pat. No. 4,198,709 shows a bowler's glove with a dorsal surface support for the index finger of the bowler. It is similar to the device shown in U.S. Pat. No. 4,441,711 and has the same failings as described above for that Patent.

U.S. Pat. No. 5,554,076 shows a soft neoprene support for the bowler's fingers placed on the surface of the bowling ball. It is not designed or intended for use on a finger inserted into the hole of a bowling ball. The device shown in this U.S. Pat. No. 5,554,076 provides support on the dorsal surface of the bowler's finger as shown in U.S. Pat. No. 4,441,711 and has the same failings as described above for that U.S. Pat. No. 4,441,711.

OBJECTS OF THIS INVENTION

It is an object of this invention to provide a means for applying the maximum natural force a bowler can produce through his or her finger, inserted into the bowling ball, at the moment of release of the bowler's finger from the bowling ball.

It is an object of this invention to provide a means for protecting the finger pad of a bowler's finger inserted into a bowling ball while allowing the bowler to apply his or her maximum natural force to the bowling ball through that inserted finger.

It is an object of this invention to provide a means for controlling a bowling ball at the moment of release by providing a means for the bowler to utilize the maximum natural force the bowler is capable of producing, by the bowler's inserted finger to lift the ball at the moment of release and impart the proper direction and spin to the ball.

It is an object of this invention to provide a means for controlling a bowling ball at the moment of release by providing a means for the bowler to utilize the maximum natural force the bowler is capable of producing, by the bowler's inserted finger, to lift the ball at the moment of release and impart the proper forward velocity to the ball.

It is an object of this invention to provide a means for controlling a bowling ball at the moment of release by providing a means for the bowler to utilize the maximum natural force the bowler is capable of producing, by the bowler's inserted finger to impart a forward spin to the at the moment of release.

It is an object of this invention to provide a means for controlling a bowling ball at the moment of release by placing a rigid shield between the hole of a bowling ball and the finger of a bowler to spread the force of the bowling ball over the finger pad of the bowler to reduce the pressure at any area within the finger pad.

It is an object of this invention to provide a means for controlling a bowling ball at the moment of release and to facilitate the removal of the bowler's finger from the ball at the critical moment of release and to prevent the introduction of any forces opposed to production of the compound motion of the bowling ball produced by the spin, and velocity producing the forward motion down the alley.

It is an object of this invention to provide a means for controlling a bowling ball at the moment of release by using a limit or stop to place the finger of the bowler in the hole of the bowling ball at a defined depth where the bowler may develop consistency in his or her use of the release finger to produce the best spin, direction and velocity, in the release and delivery of the bowling ball.

These and other objects of the invention and the inventive principles, disclosed in this application, will be apparent upon a reading of the following Summary of the Invention and The Detailed Description Of The Invention.

SUMMARY OF THE INVENTION

The invention and the inventive principles disclosed are of a bowler's aid used on the finger, or fingers, of a bowler inserted into the hole, or holes, of a bowling ball. As disclosed herein, the bowler's aid comprises a support means made of rigid material, or made of a rigid material with the property of being deflectable, is made to receive or support the finger of a bowler, such as the finger of the bowler used to hold the bowling ball by means of one of the bowling ball holes.

The support means has a rest or quiescent, or stable, position or shape. According to the principles of the invention, the rigid material may be rigidly resilient to permit limited deflection or flexure around the finger joints or may be of non-flexible material with articulated joints to permit limited flexure at the finger joints. The bowler's aid may be made of a rigid material permitting no flexure, according to the principles of the invention. As would be understood from this disclosure, by one skilled in the art, deflection or flexure of the support means produces a counter force restoring the support means to it rest or quiescent or stable position.

The attachment of the bowler's aid to the finger or hand or another part of the bowler's body, at the load bearing means of the bowler's aid, creates a cantilever support for the bowler's aid, supported at its load bearing means and with the action of the bowler's aid under a deflecting force, resembling the action of a cantilever. The range of the deflection may be limited by a stop, for example limiting the backward deflection of the bowler's aid under the force of the bowling ball.

The bowler's aid may be attached to the bowler's finger or to the bowler's hand by any suitable fastening or attaching means. According to the inventive principles, the fastening means places a load bearing means on, within, or connected to the support means, on the bowler's finger or bowler's hand. This connection of the bowler's aid to the bowler's finger or hand or other part of the bowler's body, through the load bearing means, according to the principles of the invention, supports a) the force of the bowling ball applied to the bowler's finger and transferred through the support means to the load bearing means or b) the force applied from the bowler's finger or from the bowler's hand, for example, through the load bearing means to the bowler's finger and to the bowling ball.

A finger pad shield on, within or connected to the rigid material of the support means, is placed in opposition to the bowler's finger pad, when the support means is attached to the bowler's finger by the fastening or attaching means and with the load bearing means fastened, for example, to the part of the bowler's finger spatially displaced from the finger pad, or bowler's hand, in a fixed relationship.

According to the principles of the invention, as disclosed herein, the ridged and flexible support means of the bowler's aid, having the property of a developing a counter force when deflected, may be formed in a curve resembling the natural curved position of the bowler's finger. In this example, the bowler's finger is held in the shape of the natural curve of the finger where the potential strength which may be developed in the finger, is at or about, its maximum. In this way the force capable of being developed by the finger inserted into the bowling ball and used in the release of the ball in its final delivery, will be at its maximum potential.

The finger pad shield means, as part of, or connected to the support means, and made of a rigid material, or made of the same material as the support means, shields the finger pad from the forces applied between the finger pad or the tip of the finger and the ball, by distributing those forces over the widest area of contact made between the finger pad and the shield means. In this way the rigid material of the shield means prevents those force produced between the bowling ball hole and the bowler's finger, from creating pressure hot spots on the finger tip or finger pad, and reducing wear on, and fatigue of, the finger.

According to the principles of the disclosed invention, a limit means or stop may be placed on the bowler's aid, for example, on the shield means, to control the depth of insertion of the finger into the bowling ball hole. The limit or stop may be a raised surface which is designed to contact the surface of the bowling ball and indicate to the bowler, the finger has been inserted to the desired depth into the hole of the bowling ball. According to the principles of the invention, the limit means may be place anywhere on the bowler's aid which will produce a suitable indication to the bowler when his or her finger is inserted to the desired depth of the hole.

According to the principles of the invention, disclosed is a bowler's aid for use on a bowler's finger inserted into a bowling ball. The bowler's aid comprises a support means constructed of a rigid material which is formed to receive a bowler's finger. The support means includes a first part having a finger pad shield means and a second part having a load bearing means.

Connected to the support means is a fastening or attaching means. The fastening means attaches the support means to the bowler's finger with the finger pad shield means placed in contact with the finger pad and the load bearing means placed on the bowler's finger or the bowler's hand.

As would be apparent to those skilled in the art, from the disclosure of the inventive principles, the connection of the support means to the bowler's finger, or bowler's hand, through the load bearing means, and with the bowler's aid unsupported in the extent of the support means from the load bearing means to the shield means, describes a cantilever, supported at the one end of the load bearing means.

Where the bowler's aid is shaped in the natural curve of the bowler's finger, the maximum potential is available, through rotation of the bowlers finger about the first joint of the finger, for application of that force through the support means to the finger pad shield and directly to the bowling ball.

Variations in the structure of the bowler's aid may be made without departing from the principles of the invention disclosed herein. For example, the support means may be made in a curve or straight to hold the bowler's finger in a straight position, or in any variation of the straight or curved shape. The location of the load bearing means may be varied by locating on that part of the finger proximate the 3rd joint or 2nd joint or 1st joint or between these aforesaid joints or on the back or top, of the bowler's hand or the palm or underside of the bowler's hand, or by varying the extent or the bowler's finger to which the device is attached, for example on the finger and between the second and third joint or between the second and first joint, or to the back or underside of the bowler's hand, or any combination of these aforesaid arrangements, as disclosed and as would be apparent from this disclosure of the inventive principles to one skilled in the art.

The invention, as disclosed according to the inventive principles, may be practiced with or without the depth insertion, limit means or stop means. In bowling, as with other sports, consistency in practice builds consistency in results. By using the limit or stop means to indicate to the bowler when his or her finger is at the intended depth, the bowler is able to achieve a consistent withdrawal of the finger from the ball at approximately the same place in the forward delivery of the ball. It is at this critical moment, the bowler is relying on the managing the forces between the bowling ball and his or her finger pad or finger tip produce the proper combination of spin, and velocity essential to a bowler's strike, or scoring 10 pins on the first ball of the frame.

The depth insertion, stop or limit means, as disclosed according to the principles of the invention, provides an indication to the bowler when his or her finger is at the correct depth in the bowling ball hole. The stop or limit means may be varied, according to the principles of the invention, for example by a raised surface which contacts the surface of the bowling ball and prevents any more movement of the bowler's finger into the hole of the bowling ball or which provides an indication of contact of the raised surface with the edge of the bowling ball hole, permitting the bowler to insert his or her finger past that point of contact into the bowling ball hole.

DETAILED DESCRIPTION OF THE INVENTION

In the description of the invention, the same numerals used in different Figures are used to show the same or similar parts.

Figure 1:
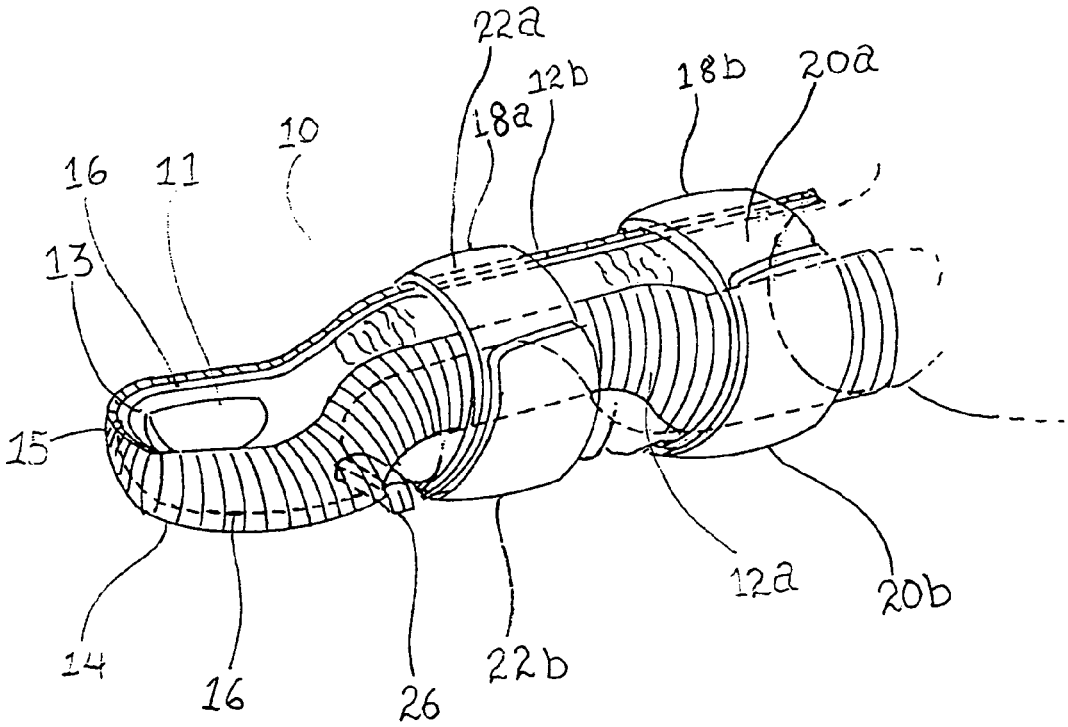
FIG. 1. shows a preferred embodiment of the disclosed invention, according to the inventive principles, extending the full length of the bowler's finger and supporting the bowler's finger in a straight position, with the fastening means in place, attaching the bowler's aid to the bowler's finger in a fixed relationship.
Figure 5:
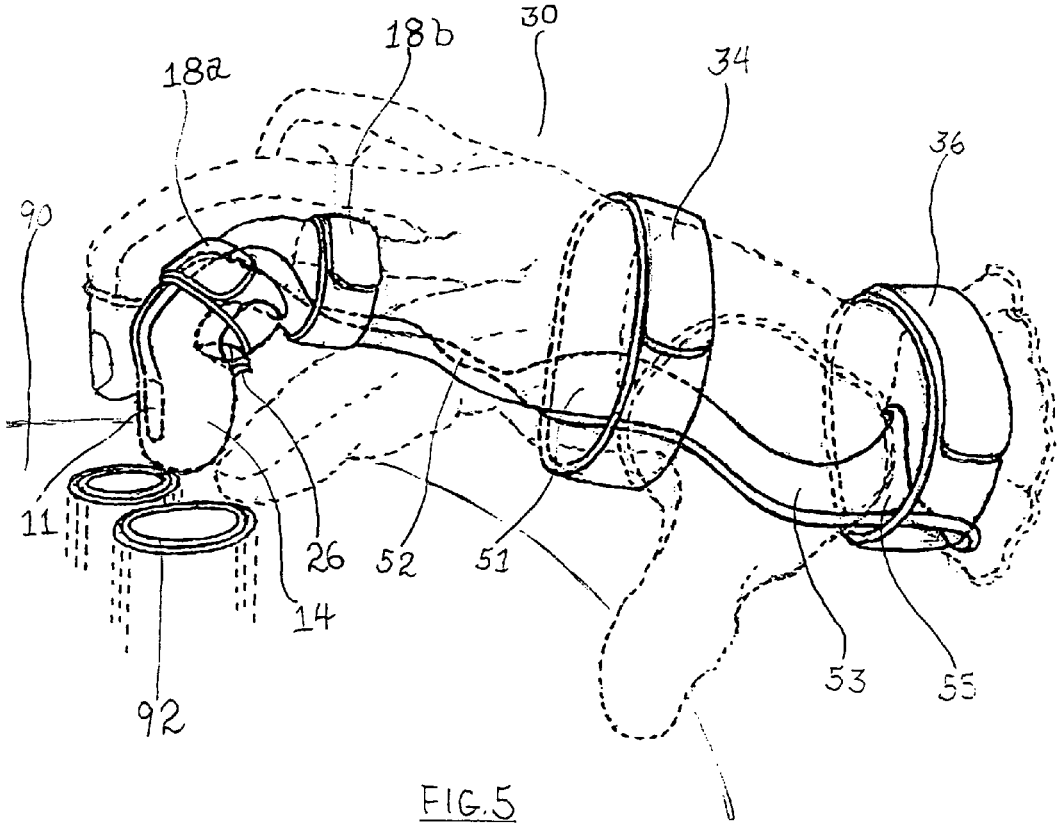
Figure 6:
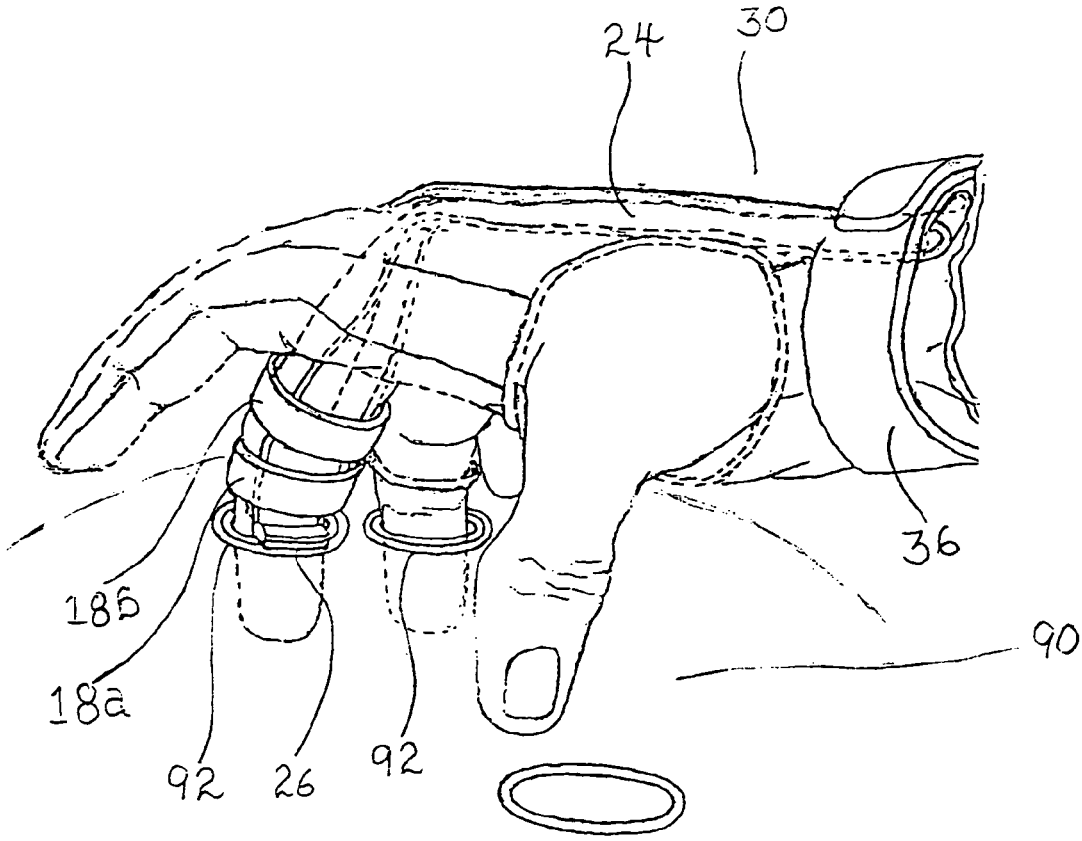
FIG. 6. shows the preferred embodiment of the invention, as shown in FIG. 3, with the bowler's finger inserted into the hole of a bowling ball and with the depth of insertion of the bowler's finger into the ball controlled by the depth limit means in contact with the surface of the bowling ball.

The invention shown as a bowler's aid 10, comprising a finger pad shield 14, may be used as shown in FIG. 1, mounted on the bowler's finger in a fixed position, with the bowler's aid supporting the bowler's finger 11. A preferred embodiment of the bowler's aid is shown in FIG. 1, in a straight position. The support means, shown as 12*a*, 12*b*, is made of a rigid material with sufficient flexibility to bend under the force of the bowler's finger as it would be bent into a position to be placed in the holes of the bowling ball, for example as shown in FIG. 6. According to the principles of the invention, the bowler's aid, although shown as straight in its quiescent or stable position, may be made in a curved shape to hold the bowler's finger in a naturally curved or other curved shape, when the support means 12*a*, 12*b*, is in its quiescent or stable position. As shown in FIG. 1, the bowler's aid may be made straight to hold the bowler's finger in a straight position or in any variation between the straight and curved position or in a position more extensively curved than the curved position shown in FIG. 5 or 6.

The support means 12*a*, 12*b*, is made of a rigidly flexible material such as "Aquaplast." According to the principle of this invention, the rigidly flexible material holds the bowler's finger in a fixed or stable position while permitting limited deflection or flexure of the finger. As would be understood by one skilled the art, the support means 12*a*, 12*b*, of the bowler's aid, when deflected under a deflecting force develops a counter force to restore the support means to its quiescent or stable, position.

The bowler's aid is shown attached to the bowler's finger 11, with end 13 of the bowler's finger placed in opposed relationship to the end 15 of the finger ad shield means 14.

The ability of the support means 12*a*, 12*b*, to be deflected while developing a counter force to the same force causing the deflection, in the manner of a cantilever, supports the bowler's finger in the delivery of the ball. First, in the delivery of the bowling ball, the force of the bowling ball against the bowler's finger tends to force the bowler's finger back away from the palm of the bowler's hand and in a rotational direction toward the back of the bowler's hand. The bowler's aid, under the force of the bowling ball develops a counter force against that backward rotation which tends to hold the bowler's finger in its stable position. Second, when the bowler might rotate his or her finger forward in the rotational direction toward the palm of the bowler's hand, to drive the bowling ball forward or to lift the bowling ball for spin, the bowler's aid deflects under the force of the bowler's finger permitting the bowler to impart that natural force through the support means to the shield means 14 and to the bowling ball.

According to the preferred embodiment show in FIG. 1, the bowler's aid 1 comprised support means 12*a* and 12*b* extending along the bowler's finger to that part of the bowler's finger between the bowler's finger 1st joint and 2nd joint. A part of the support means 12*b* is shown partly hidden by the right side of the bowler's finger, where, the bowler's aid is shown on the finger of the bowler's right hand.

The support means 12*a*, 12*b*, as shown in the preferred embodiment, may include or have attached to it, a shield means 14 shaped to receive the finger pad 16, of the bowler's finger, shown hidden, within shield means 14. According to the principles of the invention, the shield means 14 may an integral part of the support means 12*a*, 12*b*, or may be made separately and attached to the support means 12*a*, 12*b*.

Figure 4:
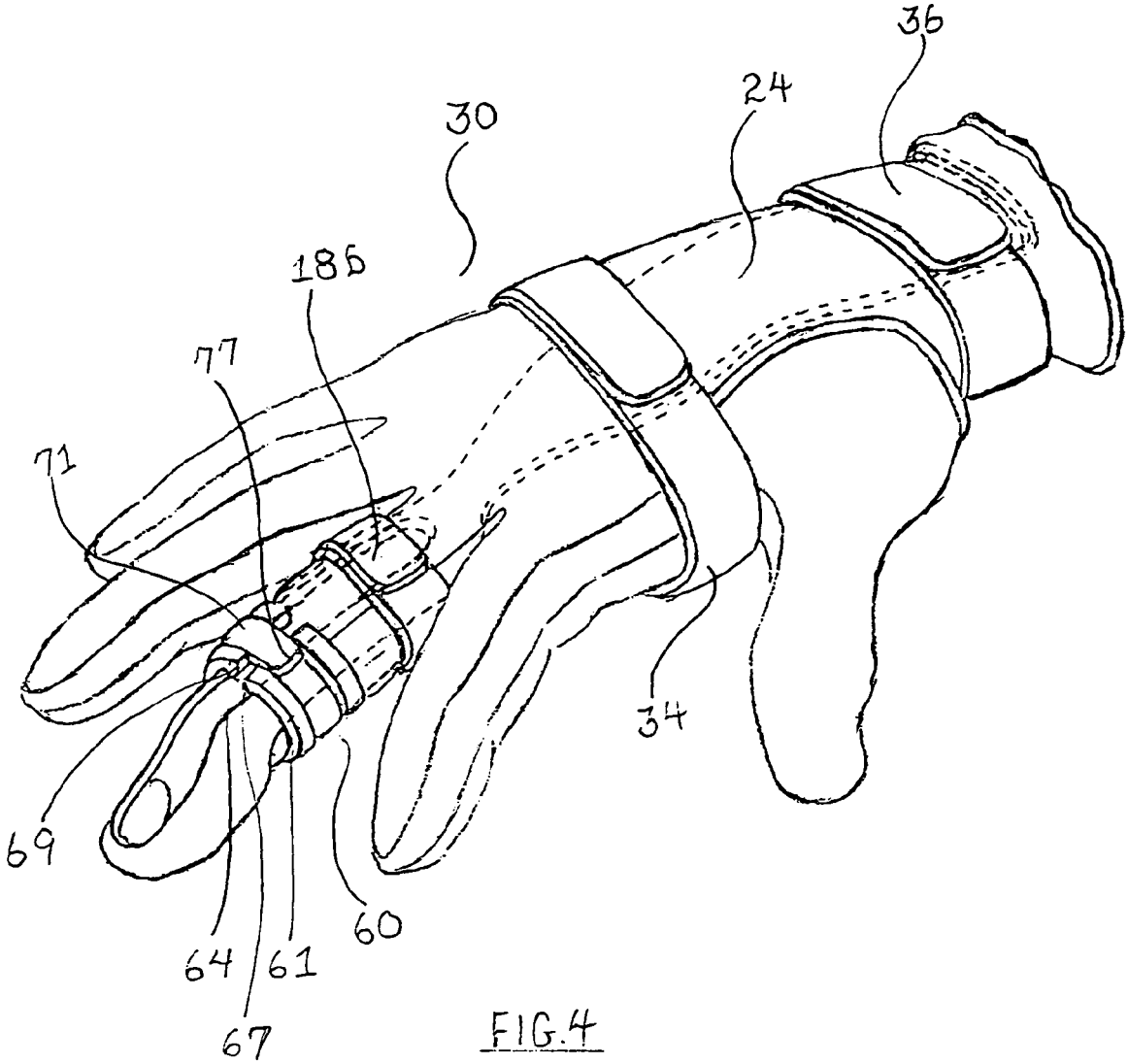
FIG. 4. show's the preferred embodiment of the invention, as shown in FIG. 3, with the support means held in place on the bowler's finger by means of a clamp FIG. 5. shows the preferred embodiment of the invention with the support means in a curved position, extending the length of the bowler's finger to the palm of the bowler's hand and held in place by a glove on the bowler's hand and by flexible straps around the bowler's finger and bowler's hand and with the bowler's finger positioned to be placed in the holes of the bowling ball.

Fastening means are shown as flexible straps 18*a* and 18*b*. In the preferred embodiment, the straps 18*a* and 18*b* are shown wrapped around the finger 11 and the support means 12*a* and 12*b* and are arranged to hold the bowler's finger 11 within the support means 12*a* and 12*b* in a fixed position, with the bowler's finger pad 16, shown hidden, within the shield means 14. According to the principles of the invention, and as shown in FIG. 4, the fastening means may be a clamp, shown as 60 in FIG. 4, made in the form of a ring that fits over the support means 12*a*, 12*b* of the bowler's aid and which may include a locking mechanism so the clamp may be tightened around the bowler's finger and the support means and be locked into place. Such a clamp and locking mechanism may be made of the same or similar rigidly flexible material.

The fastening means, shown in the preferred embodiments of FIGS. 1 to 8, may be varied, according to the principles of the invention and as would be known to one skilled in the art, from this disclosure to any suitable means for securing the bowler's finger to the support means.

The support means 12*a*, 12*b*, includes a load bearing means as part of the support means or attached to the support means. The load bearing means is any part of the bowler's aid that, as its name implies, bears the load transferred from the finger pad shield means 14, by the support means to the load bearing means or bears the load applied to the load bearing means and transferred by the support means 12*a*, 12*b* to the finger pad shield means 14. For example, as explained in connection with the preferred embodiment, and according to the principles of the invention, a force applied by the bowler, to the load bearing means, is applied to the support means 12*a*, 12*b*. The load bearing means, according to the principles of the invention, may be attached to, or formed integral with, the support means, or may be formed and made an operative part of the bowler's aid when the bowler's aid is placed on the bowler's finger and fixed in place by means, for example, by the fastening or attaching means, 18*a*, 18*b*. As shown in the preferred embodiment, and according to the principles of the invention, the load bearing means may be that part of the fastening means 20*a*, 22*a*, placed against the bowler's finger dorsal or back surface or that part of the fastening means 20*b*, 22*b*, placed against the bowler's finger under surface, when the bowler's aid is in place and fastened to the bowler's finger in its operative position, as shown for example, in FIG. 1.

Accordingly, the load bearing means may be a preformed part of the bowler's aid, or may be formed as part of another functioning piece of the bowler's aid, such as, for example, the fastening means shown as flexible straps 18*a*, 18*b*. In the case of the flexible straps, as disclosed, the load bearing means are those parts 20*a*, 22*a* and 20*b*, 22*b*, located on the dorsal and under surface of the bowler's finger where a force against the shield means 14 would be transferred by the support means 12*a*, 12*b*.

Figure 3:
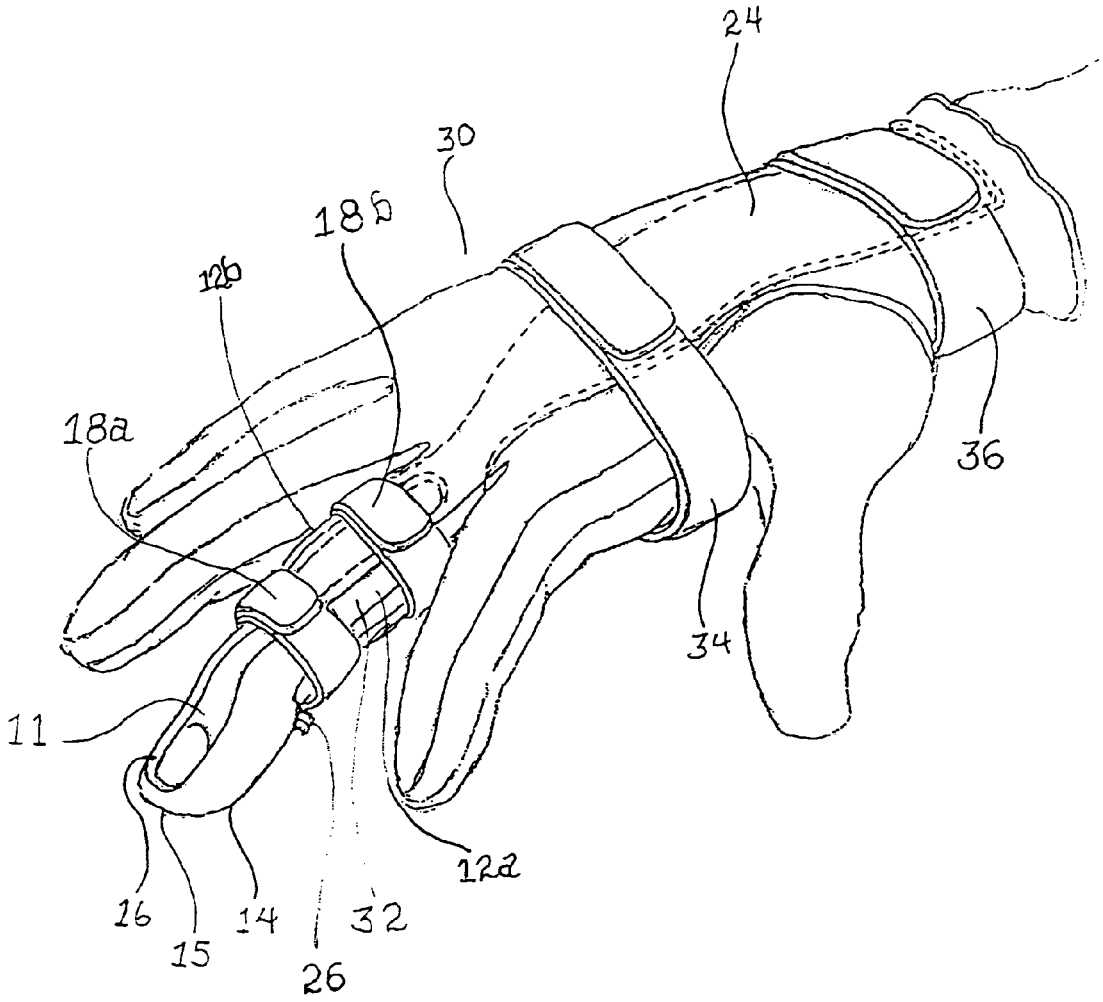
FIG. 3. shows the preferred embodiment of the invention, as shown in FIGS. 1 and 2, with the support means supporting the bowler's finger in a curved position and with the support means extending from the full length of the bowler's finger to the back of the bowler's hand and inserted into or attached to a bowler's glove, and held in place by flexible straps around the bowler's finger and around the glove on the bowler's hand.

According to the principles of the invention, the location of the load bearing means may be varied. For example, it may be located on that part of the bowler's finger located between the 3rd and 2nd joint, and the 1st and 2nd joint, as shown in FIG. 1, and in the other Figures such as FIG. 3. In an embodiment, (not shown) the bowler's aid may be shortened from the embodiment shown in FIG. 1, so it extends only from the shield means 14, to the part of the bowler's finger between the 1st and 2nd joint, or to the 2nd joint of the bowler's finger. In another example, as shown in FIG. 3, the support means may extend past the 1st joint of the bowler's finger and to the load bearing means 24 on the back of the bowler's hand, as shown in FIG. 4, or on the palm of the bowler's hand, as shown by numeral 51, 52, 53, 55, in FIG. 5. The shield means 14 is shown in FIG. 5, mounted on the bowler's finger 11 and held over hole 92 of the bowling ball 90 and with depth limit means 26 attached to the finger pad shield means 14.

The load bearing means may be as shown and described above, or according to the principles of the invention, may be any part of the bowler's aid which receives the force of the bowing ball against the finger pad shield means 14, and transfers that force to the bowler's finger or bowler's hand or other part of the bowler's body. Or, the load bearing means as shown and described above, according to the principles of the invention, may be any part of the bowler's aid which receives the force of the bowler applied to the bowler's aid and transfers that force to the support means, 12*a*, 12*b* and to the bowling ball through the shield means 14.

For the preferred embodiment, as shown for example, in FIG. 1, when in use, the bowler's aid is attached to the bowler's finger 11, and is supported at one end at the load bearing means 20*a*, 22*a* and 20*b*, 22*b*, in a cantilevered support. The load bearing means is formed by when the bowler's aid is placed on the bowler's finger and the fastening means are engaged to hold the bowler's aid on the bowler's finger in a fixed position.

In this connection, the load bearing means 20*a*, 22*a*, receives the force, transferred by support means 12*a*, 12*b*, from the bowling ball against the shield means 14 and load bearing means 20*b*, 22*b*, receives the force when the bowler's finger or hand is bent, causing a force to be applied against load bearing means 20*b*, 22*b* and to the finger pad shield means 14, through the support means 12*a*, 12*b*. According to the principles of the invention, as shown in the preferred embodiment of FIG. 1, the bowler's aid is made to hold the bowler's finger in a straight position and to deflect under the force of the bowler's finger when bent, for example, for insertion into the hole of a bowling ball, as shown in FIG. 5, or as shown in FIG. 6. In the straight position of the bowler's aid, as shown in the preferred embodiment of FIG. 1, the bowler's aid through the support means 12*a*, 12*b*, develops a counter force to resist the force of the bowling ball against the bowler's finger and assists the bowler in using his or her natural force at the critical moment of release.

The support means 12*a*, 12*b* and the finger pad shield means 14 may be made from a moldable material which, when in its formed or stable state, is rigid and not flexible or rigid while permitting a small amount of deflection of the finger when fixed in place by the fastening means 18*a*, 18*b* or varied to permit a range of deflection under the force of the bowling ball or the bowler's finger. Any material of such characteristics may be used, as would be known to those skilled in the art. For example one such well known material is "Aquaplast," as stated above.

Figure 2:
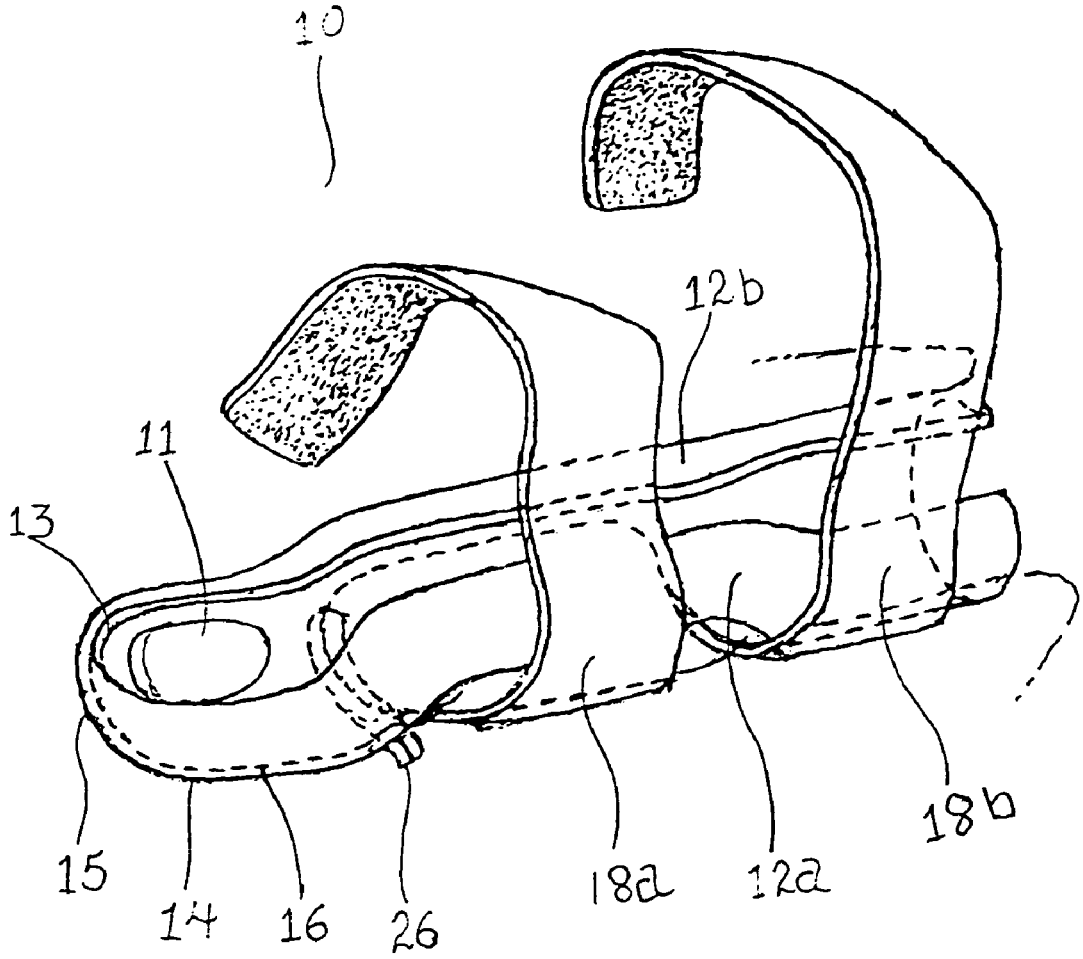
FIG. 2 shows the preferred embodiment of the invention, as shown in FIG. 1, with the bowler's finger in the bowler's aid and with the flexible fastening means, as shown in a loosened state.

FIG. 2 shows the preferred embodiment of the bowler's aid 10, as shown in FIG. 1, on the bowler's finger 11 and with the fastening means 18*a*, 18*b* shown in a loosened state. The fastening means 18*a*, 18*b* are shown attached to the support means 12*a*, 12*b*. In the preferred embodiment, the fastening means, shown in a loosened state, would be wrapped around the bowler's finger and the support means to hold the bowler's finger 11 fixed to the support means 12*a*, 12*b* with the shield mean 12 placed opposite the finger pad 14 of the bowler's finger 11 and the contact areas 20*a* and 20*b*, of fastening means 18*b* and contact areas 22*a* and 22*b* of fastening means 18*a*, as shown in FIG. 1.

The fastening means shown for the preferred embodiment, as for example in FIG. 1, may be a flexible strap material and include Velcro or other suitable means for holding the fastening means 18*a*, 18*b* in place, when wrapped around the bowler's finger and support means 12*a*, 12*b*. Other fastening means may be employed as are known to those skilled in the art, to attach the bowler's aid in a fixed manner to the bowler's finger. For example, a flexible clamp, as shown and described in connection with FIG. 4, and which may be molded from the same material as the support means, may be used. The flexible clamp may be separate from the bowler's aid or attached to the bowler's aid. A locking means may be located on the bowler's aid for engaging the flexible clamp and holding the flexible clamp in a locked position around the bowler's finger and the support means 12*a*, 12*b*, as shown in the preferred embodiment of FIG. 4

Where the bowler's aid extends to the bowler's hand, other arrangements may be used according to the principles of the invention and as shown in the preferred embodiment. For example, that part 24, of the bowler's aid, as shown in FIG. 3, extends to the back of the bowler's hand or extends to the bowler's palm, as shown in the preferred embodiment in FIG. 5, by numerals 51, 52, 53, 55. In the preferred embodiments of FIGS. 3 and 5, for example, the bowler's aid 10, is made with a glove, 30 which fits over the bowler's hand. The support means 12*a*, 12*b* are shown extending from the shield means 14, into that part of the glove 30, extending over the middle finger. That part of the support means 12*a*, 12*b* under the part 32 of the glove 30, extending over the bowler's middle finger, is shown hidden.

As in the preferred embodiment as shown in FIG. 1, the bowler's aid, according to the principles of the invention, may be held in fixed position in relation to the bowler's finger by the fastening means 18*a*, 18*b*, and by a strap 34 around the bowler's hand or wrist 36, enclosing that part 24, of the bowler's aid extending from or attached to the support means 12*a*, 12*b*, and to the back of the bowler's hand or that part of the bowler's aid 51, 52, 53, 55, to the palm of the bowler's hand, as shown in FIG. 3 and FIG. 5, respectively.

As may be seen in the preferred embodiment, as shown in FIG. 5, the part of the bowler's aid extending to the palm of the bowler's hand, extends from the location 52 of the first joint of the bowler's finger.

That part of the bowler's aid shown as 24, in FIG. 3, extending to the back of the bowler's hand, and 51, 52, 53, 55, in FIG. 5, shown extending to the palm of the bowler's hand, attached to, or part of the support means 12*a*, 12*b*, according to the principles of the invention, provides a larger counter force to any force against the bowler's aid applied at the shield means 14 or against the bowler's aid when the bowler's finger is deflected.

Figure 8:
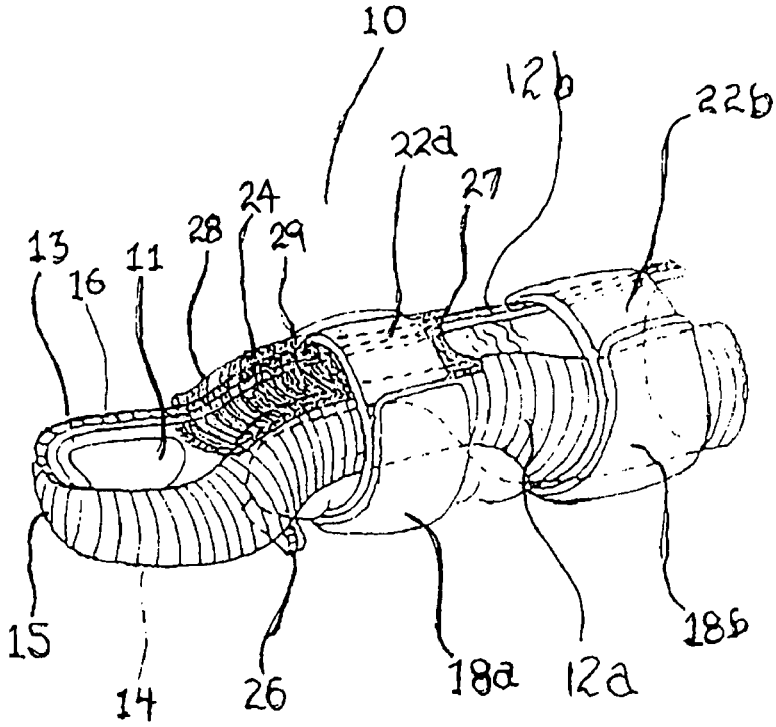
FIG. 8, shows an extension of the support means over the bowler's finger, which limits the deflection of the bowler's finger in one direction.

The Bowler's Aid may include a stop means to limit the backward deflection of the Bowler's Aid, for example under the force of the bowling ball. The deflection stop means may be any suitable device, as would be apparent to one skilled in the art from the disclosure. For example, such a deflection stop means could be an overleaf 24, as shown in FIG. 8, attached or fastened to the at one end 27 to the support means 12*a*, 12*b* or held in place by the fastening means 18*a*, 18*b*, or attached to the Bowlers Aid at one end by any suitable means as would be apparent from one skilled in the art From the disclosure of the inventive principles. A free end 27, of the overleaf 24 may extend over that part of the support means 12*a*, 12*b*, whose deflection is to be limited such as, for example, that part of the support means shown as between numerals 28 and 29 denoting the free part of overleaf 24. A similar deflection stop, as would be apparent to one skilled in the art from the disclosure of the inventive principles, could be used to stop forward deflection of the bowler's finger toward the palm of the bowler's hand, for example, when fixed to that part 51, 52, 53, 55 of the Bowler's Aid and with its free end extending over support means 12*a*, 12*b*.

As would be apparent to one skilled in the art, from the disclosure of the preferred embodiment according to the inventive principles, the shape or length of that part 24 of the bowler's aid as shown in FIG. 3, extending to the back of the bowler's hand or that part 51, 52, 53, 55, of the bowler's aid extending to the palm of the bowler's hand, as shown in FIG. 5, may be varied in length or shape, to fit the individual preferences of the bowler, without departing from the principles of the invention shown and disclosed.

The bowler's aid as shown in the preferred embodiments of FIGS. 1 to 8, using flexible straps or clamps, as a fastening means to hold the bowler's aid in place on the bowler's finger, may be varied according to the principles of the invention.

Figure 7:
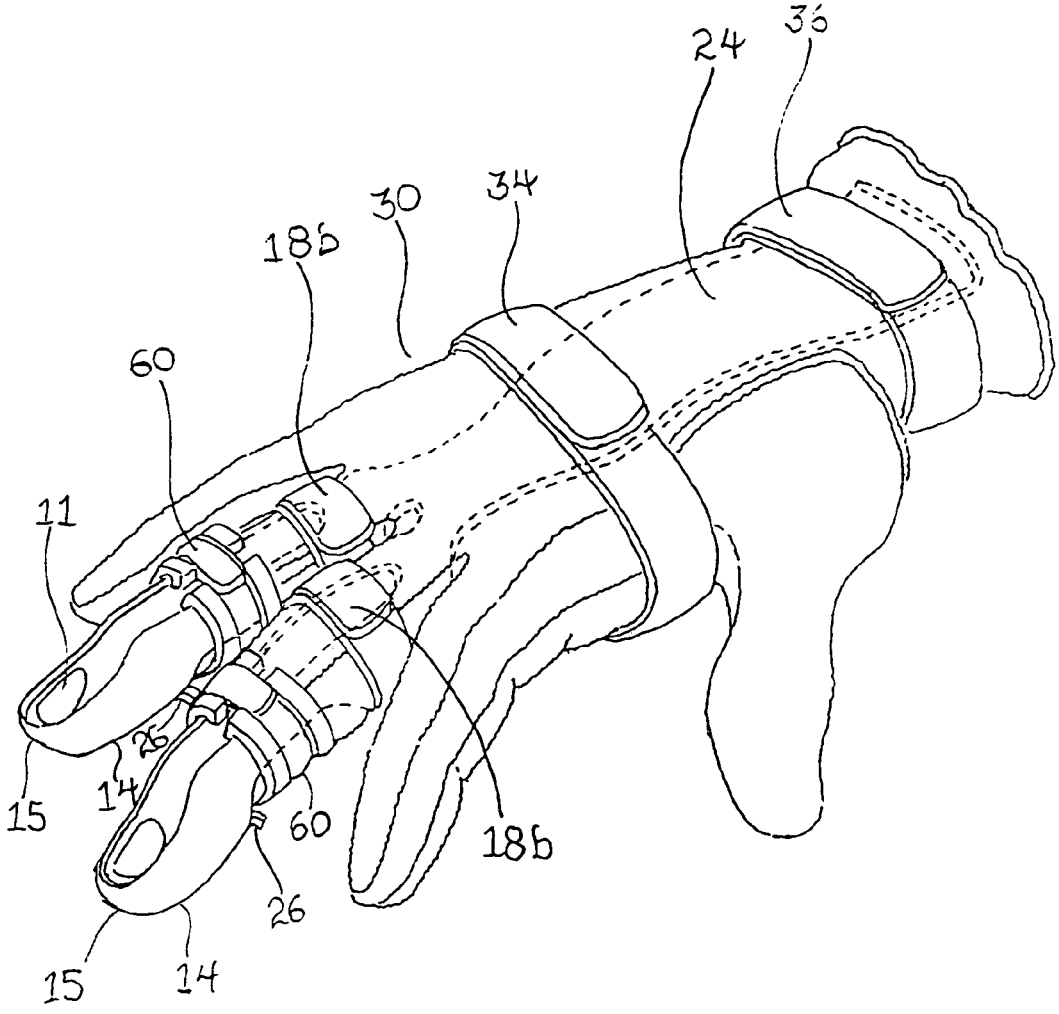
FIG. 7, shows a preferred embodiment of the disclosed invention, as shown in FIG. 3, and with separate support and shield means for the two middle fingers and the Bowlers Aid held in place with flexible straps and clamps.

The clamp 60, shown in FIGS. 4 and 7, as shown in this preferred embodiment, is made of two parts, a inner part 61 and an outer or over part 71. The inner part may be made from the same rigidly flexible material as is used to make the support means 12*a*, 12*b*. The inner part is formed in an annular ring, having an annular width and with an open circumference part 64 defined by ends 67 and 69. The size of the open part may be suitably varied, as would be apparent to those skilled in the art from the disclosure of the preferred embodiment and of the inventive principles.

The inner part 61 is made to fit around the bowler's finger, as shown in FIG. 4. Around the inner part, 61, an outer part 71 is placed. The outer part 71 may be of the same material as the inner part or other suitable material or may be made of flexible material. The outer part, 71 may include any suitable locking means, as would be known or apparent to one skilled in the art from the disclosure of the inventive principles.

In use, the inner ring may be spread at ends 67, 69, making wider the space at the open circumference part 64, as may be necessary to place the bowler's finger in the bowler's aid, as shown in FIG. 4. Alternatively, the size of the inner part 61 may be matched to the bowler's finger so the bowler's finger may be placed through the inner ring 61 leaving a space 64 between open ends 67, 69. The outer part 71 may then be placed over the inner part 61 and tightened, forcing the support means and the bowler's aid, to a fixed position on the bowler's finger, as shown in FIGS. 4. and 7.

As would be apparent to those skilled in the art, from the disclosure of the preferred embodiment according to the principles of the invention, the clamp 60 may be varied in size, fit and the means used to lock the clamp in place. For example, a series of serration on the inner part may be made to match serration's on the outer part. The serration's would be shaped to resist any force in the outer ring tending to pull the overlapping ends apart.

As would be apparent to one skilled in the art from the this disclosure, the size or shape or material of the clamp means shown in this disclosure, may be varied without departing from the inventive principles shown or described, and the terms used such as annular or width or circumference, are use approximately and not restrictively to any particular geometric shape or extent.

According to the inventive principles, and as shown in the preferred embodiment of FIG. 6, a limiting means 26, is shown located on the finger pad shield means 14 The finger pad shield means 14 is a raised surface extending away from the finger pad shield means 14 and the bowler's finger pad when the bowler's finger is placed in the bowler's aid and held in place by means of the fastening means 18*a*, 18*b*, for example.

According to the preferred embodiment shown in FIG. 6, the bowler's aid is shown on the two middle fingers of the bowler and with each of the two fingers inserted in the holes 92*a*, 92*b*, of the bowling ball 90.

The limiting means 26, as shown, for example in FIG. 6, is used to limit the depth of insertion of the bowler's finger into the bowling ball or to provide a indication to the bowler when the bowler's finger has been inserted to a desired depth, corresponding to the location of the limiting means on the bowler's aid, for example on the finger pad_shield means 14. The limiting means 26 may be placed at any location on the bowler's aid depending on the desired depth of insertion of the bowler's finger into the bowling ball hole 92. The limiting means 26 is located on the bowler's aid, in the case of the preferred embodiment as shown in FIG. 6, adjacent to the 3rd joint of the bowler's finger and between that third joint and the end 15 of the finger pad_shield means 14.

In the preferred embodiment, as shown in FIGS. 1 to 6, the bowler's aid is closed at the end 15 of the finger pad_shield means 14 and at the tip 13 of the bowler's finger and open along the dorsal or back of the bowler's finger and along the bottom or side of the bowler's finger opposite to the dorsal side. However, as would be apparent to those skilled in the art from the disclosure, the specific design or arrangement of the support means, or shield means, the bowler's aid may be open at the tip 13 of the bowler's finger and closed adjacent to the dorsal surface or the adjacent the bottom of the bowler's finger opposite to the dorsal side and the fastening means and load bearing means may be varied, without departing from the principles of the invention as described.

The operation or use of the bowler's aid, as shown in its preferred embodiment and according to the principles of the invention, is explained in the following.

As set forth above the proper release of the bowling ball is critical to the direction, velocity and spin of the ball. The bowler's finger inserted into the hole of the bowling ball, is the last contact with the bowling ball and the final opportunity for the bowler to impart the proper spin, direction and velocity to the bowling ball.

This bowler's aid assists the bowler in using his or her natural strength of the bowler's finger when receiving the force of the bowling ball against the bowler's finger and when delivering a force to the bowling ball through the bowler's finger, all at the moment when the bowler is directing the bowling ball down the alley. As shown in FIG. 3, the bowler's finger is in a naturally curved shape. It is in this position that the strength of bowler's finger is increased for holding the bowling ball and maximizing the natural force of the bowler in the delivery of the ball.

For example, a forward rotation of the bowler's finger about the 1st joint will impart a force against load bearing means 20*b*. That same force will be transmitted through the support means 12*a*, 12*b* to the finger pad-shield means 14 placed in opposition to the finger pad 16 or to front end 15 of the finger pad shield means 14, placed in opposition to the tip 13 of the bowler's finger, and to the bowling ball.

Similarly, where the bowler's finger is held in place or stationary with regard to that finger's 1st joint, the motion of the bowler's hand when delivering the ball will impart a force against load bearing means 20*b*, 22*b*. That same force will be transmitted through the support means 12*a*, 12*b* to the finger pad shield means 14 placed in opposition to the finger pad 16 or to front end 15 of the finger pad shield means 14, placed in opposition to the tip 13 of the bowler's finger, and to the bowling ball.

As will be apparent to those skilled in the art, any force generated by the weight or counter forces of the bowling ball against the bowler's finger will be transmitted from the finger pad shield means 14, whether from that part of the finger pad shield means opposed to the bowler's finger pad 14 or the end 15 opposed to the tip of the bowler's finger, through the support means 12*a*, 12*b* to the load bearing means, 20*a*, 22*a*.

The finger pad shield 14, opposed to, in contact with the bowler's finger pad 16 places a rigid surface between the force of the bowling ball against the finger pad 16 and spreads that force, when the bowler's maximum natural force is applied to the bowling ball at the moment of release. It is at this moment, as explained above, when the bowler applies the maximum force to the finger hole of the ball and the force of the bowling ball against the finger pad shield 14 and the finger pad 16 is the greatest. It is as this moment of release that and the pressure within the contact area made by the finger pad shield 14 with the finger pad 16, is spread by the finger pad shield over the area of contact on the finger pad shield 14 and made with the finger pad 16. The finger pad shield 14 is made sufficiently rigid to substantially resist any flexing or deformation from that force of the bowling ball so that force against the finger pad shield 14 is spread over the contact area. The force which the rigid finger pad 14 resist is within a range limited by the conventional limit of bowling ball weights and the limit of muscular skeletal development. In the sport of bowling, a bowler will choose a ball suitable to that bowler's muscular skeletal development and within the range of weight allowed by bowling authorities such as the American Bowling Congress. While a stronger bowler at the upper limit of muscular skeletal development, may prefer a heavier ball, the force applied from the bowling ball to the finger pad 16 will be in a range limited by the maximum weight of a bowling ball, and the maximum force which can be applied to the bowling ball within a range of muscular skeletal development. The finger pad shield prevents that force produced between the bowling ball hole and the bowler's finger pad 16, from creating pressure spots on the finger tip or within the contact area made by the finger pad shield 14 with the bowler's finger pad 16, and reducing wear on, and fatigue of, the finger pad.

As bowling is an individual sport, with each bowler having his or her individual preferences, the shape of the bowler's aid, whether straight or curved, or the amount of curve, or the shape of the shield means or whether the end 15 is closed or open or the type of fastening means, whether a clamp type or flexible straps, will depend on those preferences. Accordingly, variations may be made in the bowler's aid without departing from the principles of the invention.

For example, the bowler's aid may be made in for each of the bowler's fingers used to grasp the bowling ball by insertion into the bowling ball holes. In this connection, the glove 30, as shown in FIG. 3 would be made with the bowler's aid 10 for the middle and 4th finger, for example. The bowler's aid may be made a fixed part of the bowler's glove or removable, so the bowler may bowl with or without the bowler's aid.

As shown in the preferred embodiment of FIG. 8, and according to the principles of the invention, a means may be employed to limit the deflection of the bowler's finger in one directions and not in another direction. For example, as shown in FIG. 8, an extension 96, is fixed to the support means and one end 96 and extends over the bowler's finger 11, in the form of a cantilever 98. In the example shown, the bowler's finger may be deflected by curling the finger 11 without contacting the means 98. When the bowler's finger is deflected toward a straightened position, for example as shown in FIG. 1, the means 98 is placed in contact with the bowler's finger or the support means 12*a*, 12*b*, and is deflected in response, producing a counter force acting to limit the deflection of the bowler's finger.

The end 15 of the finger pad shield means 14 may be used to place the end 13 of the finger at a fixed distance from the depth limiting means 16, for example as shown in FIG. 1, as according to the disclosed inventive principles. The closed end 15 of the shield means may be use or the end of the finger pad shield means 14, may be open and defined by the narrowing displacement between the side walls of the shield means to limit the movement of the bowler's finger in the direction of the open end and to force it into an fixed position in relation to the distance between the end 15 of the bowler's finger in finger pad the shield means 14 and the location of the depth limiting means 26.

As would be understood by those skilled in the art, from the disclosure of the invention, the bowler's aid may be varied in form, or function, without departing from the inventive principles disclosed.

The invention claimed is:

1. A bowler's finger pad shield for protecting a finger pad from the force produced when applying lift to a bowling ball, to rotate or spin the ball at its release, comprising:

a) a finger pad shield with an open end adapted for insertion of a finger pad, said finger pad shield including a first surface and a second surface, extending from said open end; said first surface including a contact area located proximate said open end and positioned relative to said open end to receive a finger pad;

b) said second surface is opposed to said first surface;

c) said finger pad shield is adapted for insertion into the finger hole of a bowling ball, to place said second surface in contact with a bowling ball finger hole; and wherein d) said finger pad shield includes at least one fastener to hold said contact area in a fixed relationship with a finger pad; wherein a force produced in the release and lifting of the bowling ball, is spread over said contact area, and, wherein said finger pad shield includes a raised surface for contacting the surface of a bowling ball; said raised surface is located proximate said open end and adapted to limit the depth of insertion of said finger pad shield into the finger hole of a bowling ball.

2. The bowler's finger pad shield means of claim 1, wherein said raised surface extends in a direction away from said finger pad shield and said contact area.

3. A bowler's aid for assisting a bowler in applying the a bowler's maximum natural force through the bowler's finger pad inserted in a bowling ball finger hole, in lifting and rotating the bowling ball at its release, comprising, a) a finger pad shield with an open end adapted for insertion of a finger pad on said finger pad shield: said finger pad shield including a contact area located proximate said open end and adapted to receive a finger pad in said contact area; and wherein, b) said finger pad shield is substantially rigid to resist deformation from a force produced when a maximum natural force is applied through a finger hole of said bowling ball, to lift and rotate said bowling ball at its release, and to spread said force produced, over said contact area and wherein said finger pad shield includes a raised surface extending away from said finger pad shield and said contact area and adapted to contact the surface of a bowling ball; and limit the depth of insertion of said finger pad shield into the finger hole of a bowling ball.

4. A bowler's finger pad shield for protecting a bowlers finger pad when inserted into a bowling ball finger hole, from the force produced when lifting the bowling ball to apply spin or rotation at its release, comprising, a) means for forming a contact area with a finger pad;

b) means for holding a finger pad in a fixed position with said means for forming a contact area and in a fixed position with a contact area formed with said means for forming a contact area with a finger pad;

c) said means for forming a contact area with a finger pad including means for spreading a force produced when applying lift to said bowling ball, at its release, over said contact area, and including means for contacting the surface of a bowling ball to limit the depth of insertion into the finger hole of a bowling ball of said means for forming a contact area with a finger pad.

* * * * *